US007251963B2

(12) United States Patent
Kim et al.

(10) Patent No.: US 7,251,963 B2
(45) Date of Patent: Aug. 7, 2007

(54) DRUM-TYPE WASHING MACHINE

(75) Inventors: Kwang Soo Kim, Changwon-si (KR); Jae Moon Kim, Jinhae-si (KR); Sam Je Park, Gimhae-si (KR); Hyun Jae Lee, Jinju-si (KR)

(73) Assignee: LG Electronics Inc, Seoul (KR)

( * ) Notice: Subject to any disclaimer, the term of this patent is extended or adjusted under 35 U.S.C. 154(b) by 577 days.

(21) Appl. No.: 10/670,785

(22) Filed: Sep. 26, 2003

(65) Prior Publication Data

US 2004/0148978 A1 Aug. 5, 2004

(30) Foreign Application Priority Data

Sep. 26, 2002 (KR) ..... 10-2002-0058520

(51) Int. Cl.
*D06B 3/00* (2006.01)
*D06B 3/20* (2006.01)
*D06F 17/00* (2006.01)

(52) U.S. Cl. ..... 68/196; 68/147; 68/175; 68/198

(58) Field of Classification Search ..... 68/147, 68/175, 196, 198
See application file for complete search history.

(56) References Cited

U.S. PATENT DOCUMENTS 2,968,174 A * 1/1961 Bell et al. ..... 68/23.6
3,159,174 A * 12/1964 Searle et al. ..... 137/374

* cited by examiner

*Primary Examiner*—Michael Barr
*Assistant Examiner*—Rita R Patel
(74) *Attorney, Agent, or Firm*—McKenna Long & Aldridge

(57) ABSTRACT

A drum-type washing machine employs a gasket water draining hose to enable used water to be discharged via the drainpipe, immediately following a washing or rinsing step. The drum-type washing machine includes a cabinet having a door; a tub for containing water, the tub having an entrance corresponding to the door of the cabinet; a gasket, connecting the door of the cabinet to the entrance of the tub, to prevent water contained in the tub from leaking outside the tub, the gasket having a first orifice provided at a bottom point thereof; a drainpipe, communicating with the tub, to discharge water contained in the tub, the drainpipe having a second orifice provided at one side thereof; and a water draining hose, communicating the first orifice with the second orifice, to discharge water via the drainpipe.

17 Claims, 5 Drawing Sheets

DRUM-TYPE WASHING MACHINE

This application claims the benefit of the Korean Application No. 10-2002-0058520 filed on Sep. 26, 2002, which is hereby incorporated by reference.

BACKGROUND OF THE INVENTION

1. Field of the Invention

The present invention relates to drum-type washing machines, and more particularly, to a drum-type washing machine having a hose for draining water remaining in a gasket installed between a door and an entrance to a tub.

2. Discussion of the Related Art

Generally speaking, laundering using a drum-type washing machine is carried out using a frictional force between the laundry and a rotating drum that receives the driving force of a motor. Such a method causes little damage to the laundry, prevents the laundry from getting tangled, and achieves such washing effects as beating and rubbing.

Referring to FIG. 1, for illustrating a drum-type washing machine and in particular a drying function thereof, a tub 2 for containing water is installed inside a cabinet 1, and a drum 3 for receiving laundry is rotatably installed inside the tub. A door 5 is installed at a front side of the cabinet 1, and a gasket 4 for preventing water leakage is installed between the door 5 and an entrance to the tub 2. The gasket 4 is typically contoured to provide stress relief and cushion between the door 5 and tub 2 during normal operation.

To drain the tub 2 and drum 3 after completion of a wash or rinse step, a drain pipe 20 is provided below the tub, connected at the tub's bottom, to discharge water. The drainpipe 20 is typically a bellows type made of a flexible material.

Thereafter, a drying step is typically performed using a drying duct 6, provided in an upper area of the cabinet 1, for communicating with the external environment and allowing air from the drum 3 and tub 2 to circulate. The drying duct 6 communicates with the interior of the drum 3 and tub 2 via the gasket 4, which is provided with an orifice part 410 for connecting to the drying duct on an upper side of the gasket. To facilitate drying, a heater 7 is mounted in the drying duct 6.

FIG. 2 shows the state of the gasket 4, after the above drying step, and a deposit of water W.

As shown in FIG. 2, even after discharging water from the drum 3 and tub 2 using the drainpipe 20 and then performing the drying step using the heater 7 and drying duct 6, a considerable amount of residual water W gathers at and remains in a recess formed around a bottom point of the gasket 4. That is, the drying step of a drum-type washing machine constructed as above is unable to eliminate all of the water.

Left alone over time, the residual water W becomes unhygienic. For example, the residual water W would eventually emit a foul odor and, as standing water, would become a potential source for bacteria and insects.

In addition, the residual water W accelerates a breakdown of the gasket 4. For example, the water may become frozen, which is a common occurrence in some cold-climate countries where machine laundering may be performed in an unheated room.

Meanwhile, the residual water W is likely to be contaminated. Accordingly, if a subsequent wash or rinse step is executed while the residual water W remains in the gasket 4, the contaminated water would combine with any water being newly supplied to the drum 2 and tub 3. Even if the contaminated water evaporates over time, a dry residue would inevitably remain and a contamination of the water of the subsequent wash or rinse step would still occur. In any event, the residual water W degrades the washing process.

SUMMARY OF THE INVENTION

Accordingly, the present invention is directed to a drum-type washing machine that substantially obviates one or more problems due to limitations and disadvantages of the related art.

An object of the present invention is to provide a drum-type washing machine, which prevents water contamination, improves washing quality, and avoids an unnecessary breakdown of a gasket, by immediately eliminating residual water remaining in the gasket after completion of a wash or rinse cycle.

Additional advantages, objects, and features of the invention will be set forth in part in the description which follows, and in part will become apparent to those having ordinary skill in the art upon examination of the following or may be learned from practice of the invention. The objectives and other advantages of the invention may be realized and attained by the structure particularly pointed out in the specification and claims hereof as well as in the appended drawings.

To achieve these objects and other advantages and in accordance with the purpose of the invention, as embodied and broadly described herein, there is provided a drum-type washing machine comprising a cabinet having a door; a tub for containing water, the tub having an entrance corresponding to the door of the cabinet; a gasket, connecting the door of the cabinet to the entrance of the tub, to prevent water contained in the tub from leaking outside the tub, the gasket having a first orifice provided at a bottom point thereof; a drainpipe, communicating with the tub, to discharge water contained in the tub, the drainpipe having a second orifice provided at one side thereof; and a water draining hose, communicating the first orifice of the gasket with the second orifice of the drainpipe, to discharge water via the drainpipe.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Throughout the drawings, like elements are indicated using the same or similar reference designations where possible.

Figure 1:
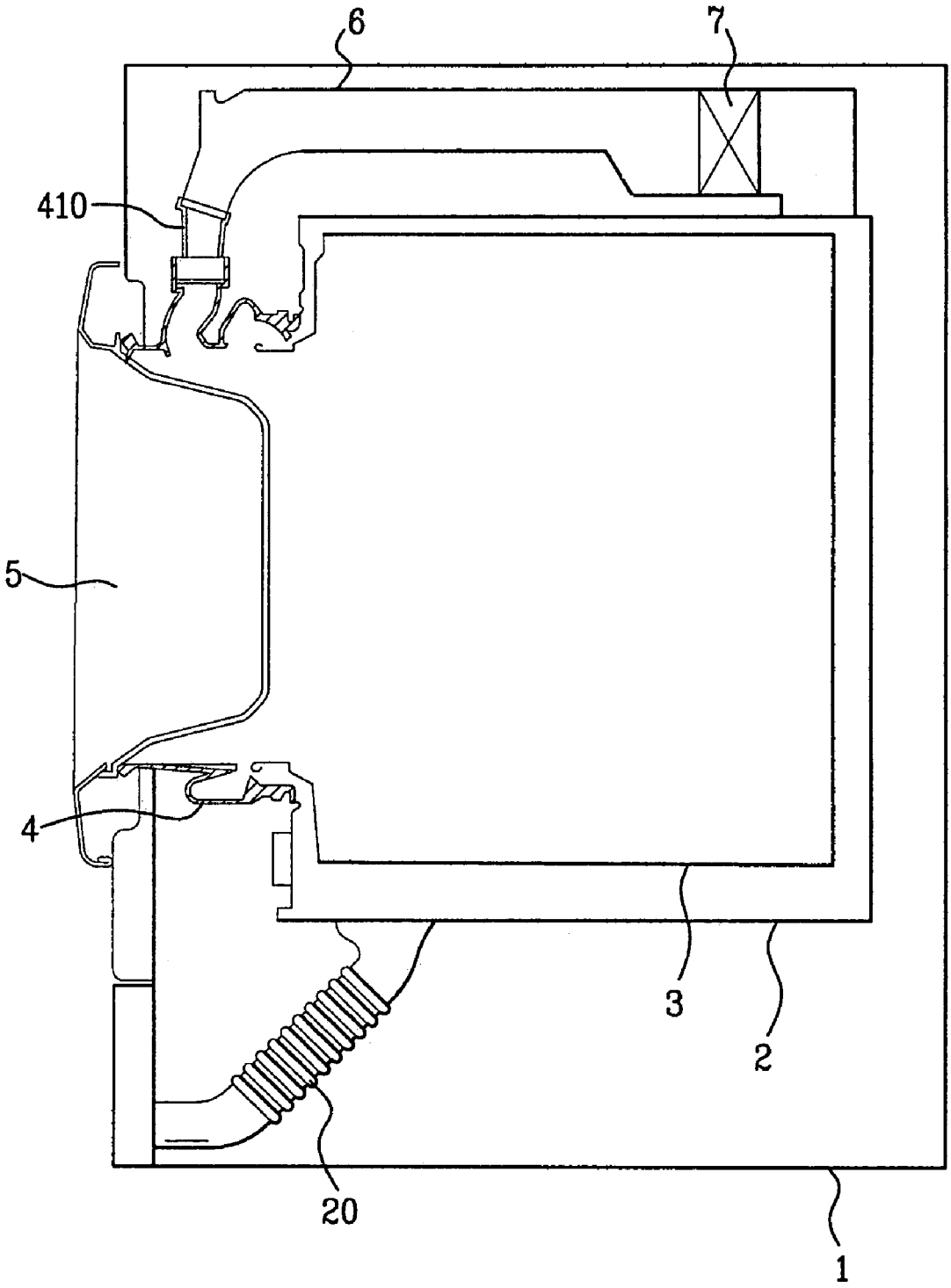
FIG. 1 Related Art
FIG. 1 is a cross-sectional side view of a drum-type washing machine according to a related art.
Figure 2:
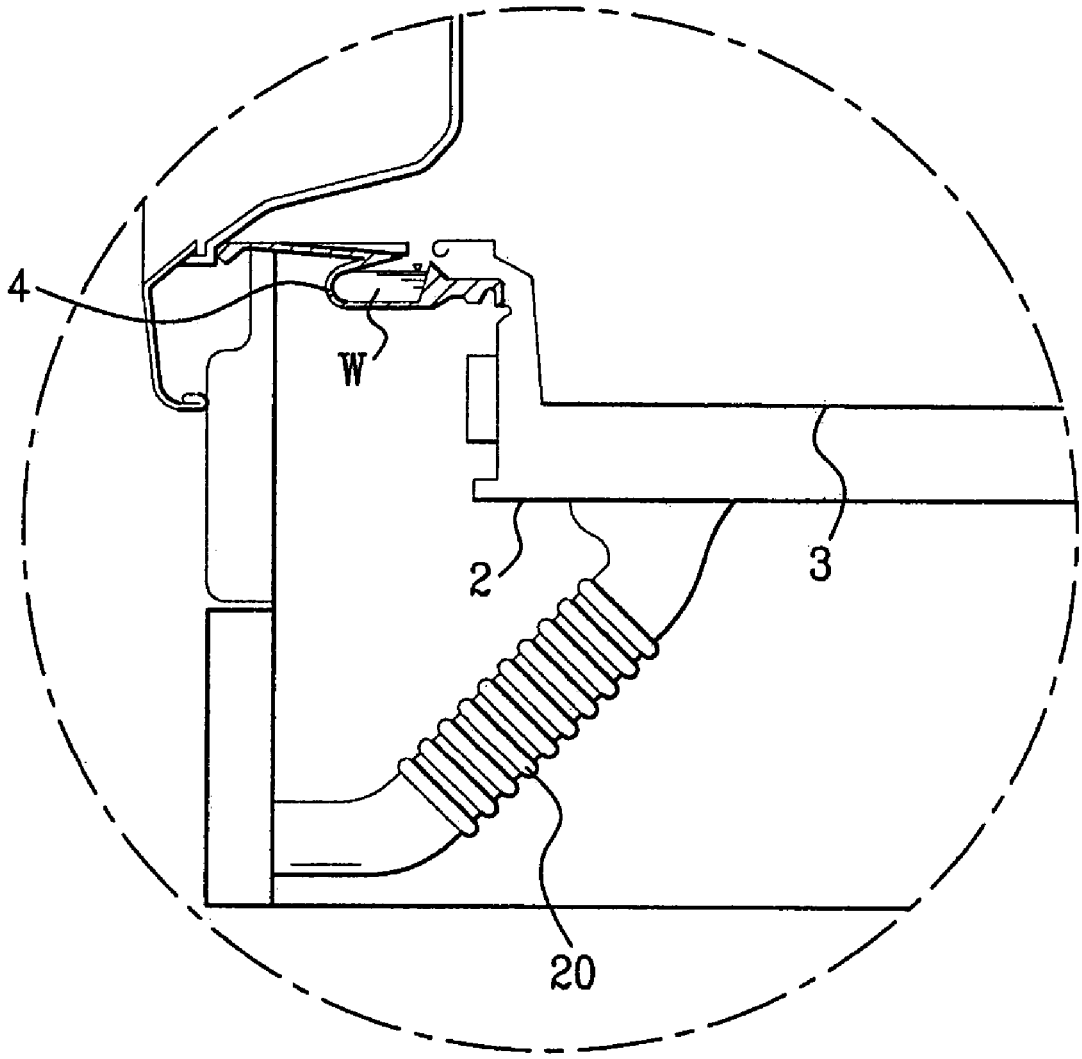
FIG. 2 Related Art
FIG. 2 is a cross-sectional side view of the drum-type washing machine of FIG. 1, showing water remaining in the gasket after completion of a drying step.
Figure 3:
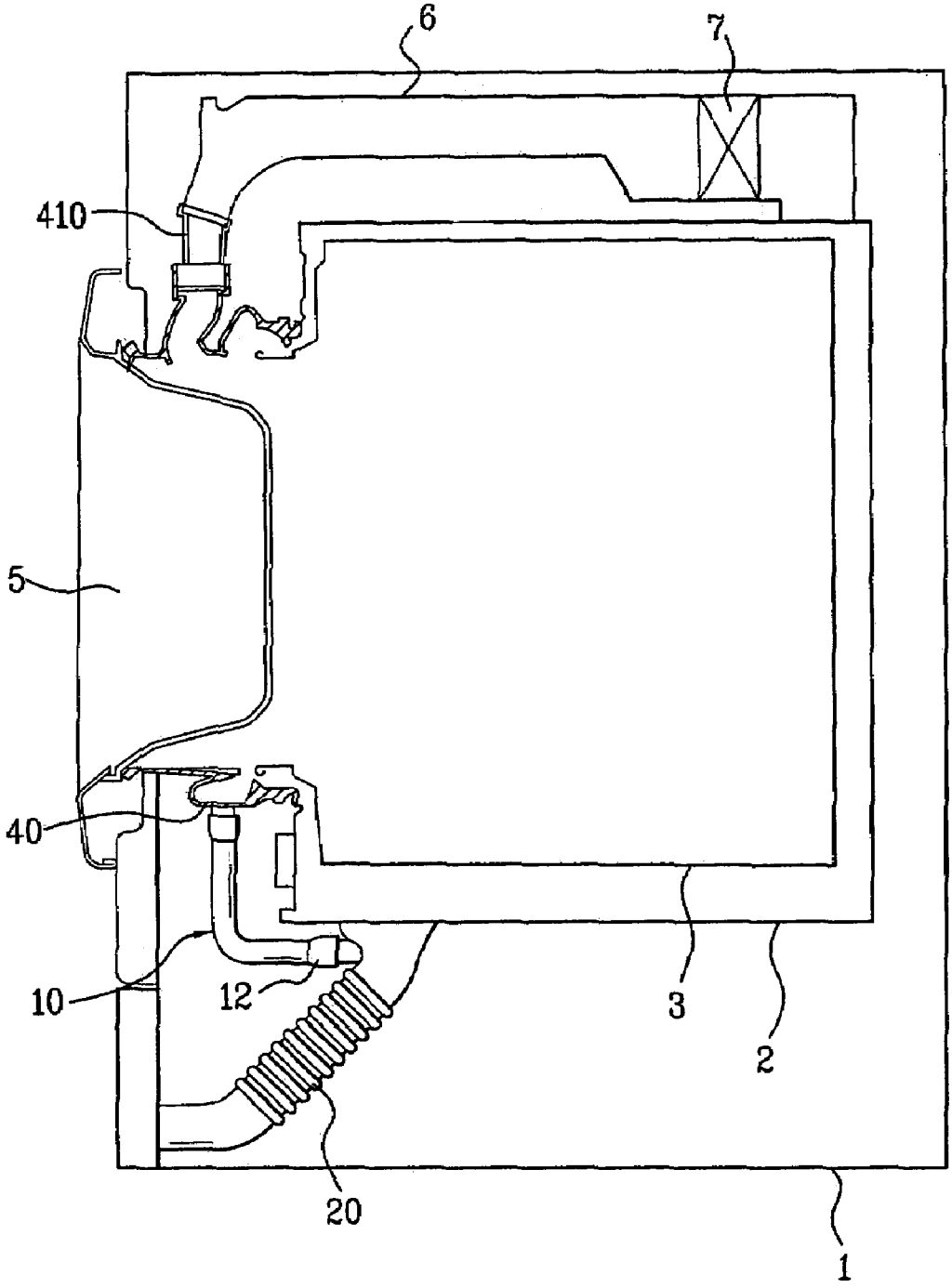
FIG. 3 is a cross-sectional side view of a drum-type washing machine according to a preferred embodiment of the present invention.
Figure 4:
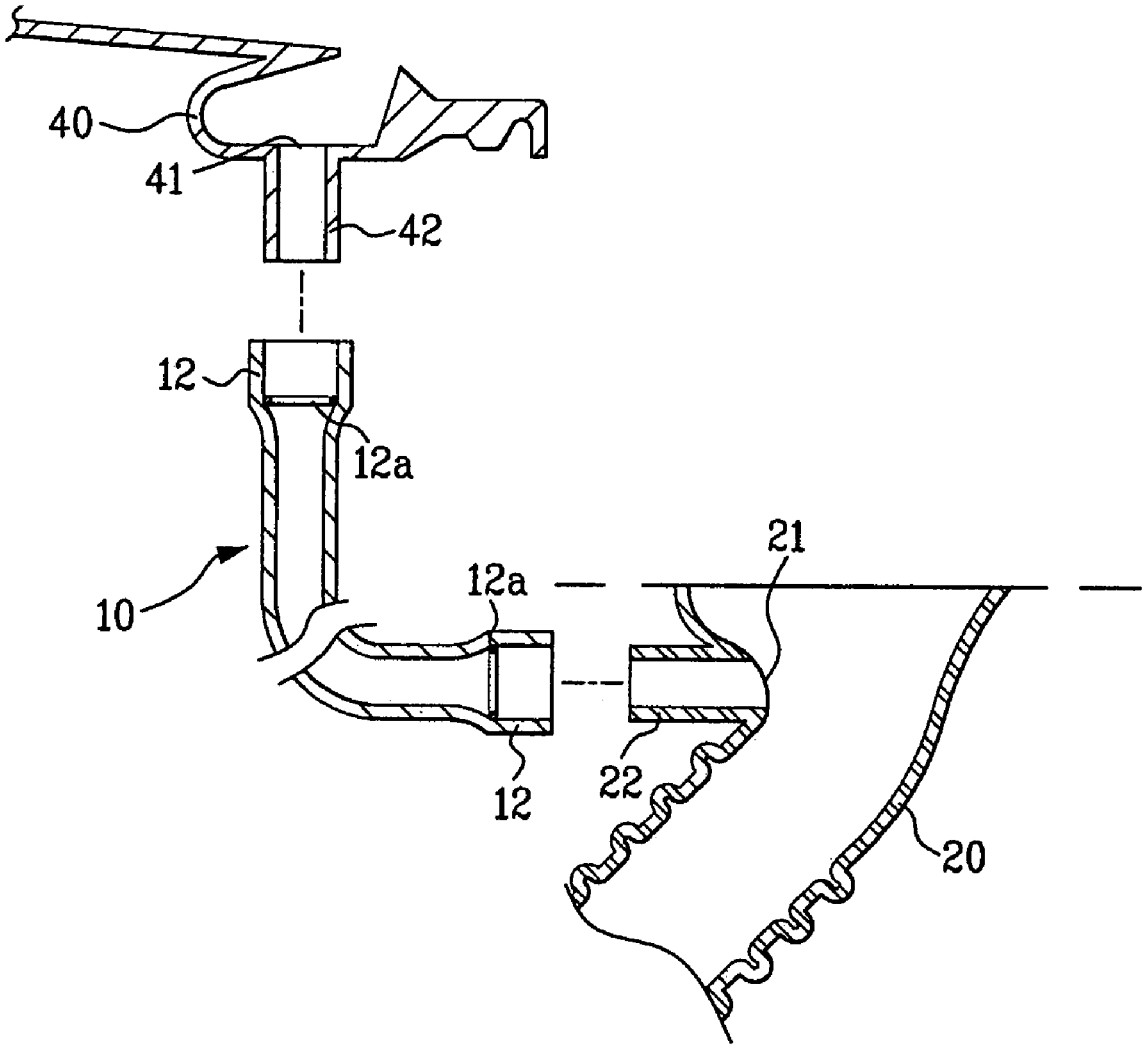
FIG. 4 is a cross-sectional breakaway view of the drum-type washing machine of FIG. 3, showing a gasket water draining hose.

Referring to FIGS. 3 and 4, illustrating a drum-type washing machine according to a preferred embodiment of the present invention, a drum-type washing machine comprises a cabinet 1, a tub 2 for containing water, a drum 3 for receiving laundry, a gasket 40 for preventing water contained in the tub from leaking outside the tub, a door 5, and a drainpipe 20. The tub 2 is installed inside the cabinet 1, and the drum 3 is rotatably installed inside the tub. The door 5 is installed at a front side of the cabinet 1, the gasket 4 is installed between the door 5 and an entrance of the tub 2 and is made of a pliable material, such as rubber, and the drainpipe 20 is connected to a lower side of the tub to discharge water contained in the tub. The drainpipe 20 is preferably a bellows type made of a flexible material.

In a drum-type washing machine according to the present invention, a first orifice 41 is provided at a bottom point of the gasket 40, a second orifice 21 is provided at one side of the drainpipe 20, and a water draining hose 10 connects the orifices 41 and 21 to each other. The water draining hose 10 may be integrally formed with the gasket 40 and/or the drainpipe 20 or may be formed as a wholly detachable unit.

To enable construction of a detachable water draining hose 10, the gasket 40 is preferably provided with a first boss 42, consisting of a cylindrical piece protruding a predetermined length from the orifice 41 at the bottom point of the gasket, and a second boss 22 consisting of a cylindrical piece protruding a predetermined length from the orifice 21 at one side of the drainpipe 20. The lengths of the first and second bosses 42 and 22 should provide for a secure connection of the water draining hose 10. The first boss 42 is for receiving one end of the water draining hose 10, while the second boss 22 is for receiving the other end. A pair of coupling members in the form of fitting stops 12 may be provided at either end of the water draining hose 10, for coupling with the bosses 42 and 22, respectively, and coupling is achieved by respectively fitting a fitting stop to each boss.

The first and second bosses 42 and 22 are preferably formed of a material other than the rubber of the gasket 40 and are most preferably formed of a durable synthetic material, such as a hard plastic. Meanwhile, the water draining hose 10 may be formed of a plastic or metal, to have a fixed shape or a substantially fixed shape. To impart the water draining hose 10 with a flexible property, a material such as rubber or plastic may be used. As for the fitting stops 12*a*, an effective fit can be achieved using an elastic material such rubber or flexible plastic. As an alternative, the fitting stops 12 may be formed of a rigid material such as hard plastic or metal, in which case a rubber bushing 12*a* is preferably formed inside each fitting stop, to prevent water leakage under pressure.

In connecting the water draining hose 10, it is important that no portion of the hose hangs below the second boss 22 of the drainpipe 20. The water draining hose 10 must be securely positioned so that, throughout the dewatering and drying steps, the hose's full length resides above the second boss 22.

Figure 5:
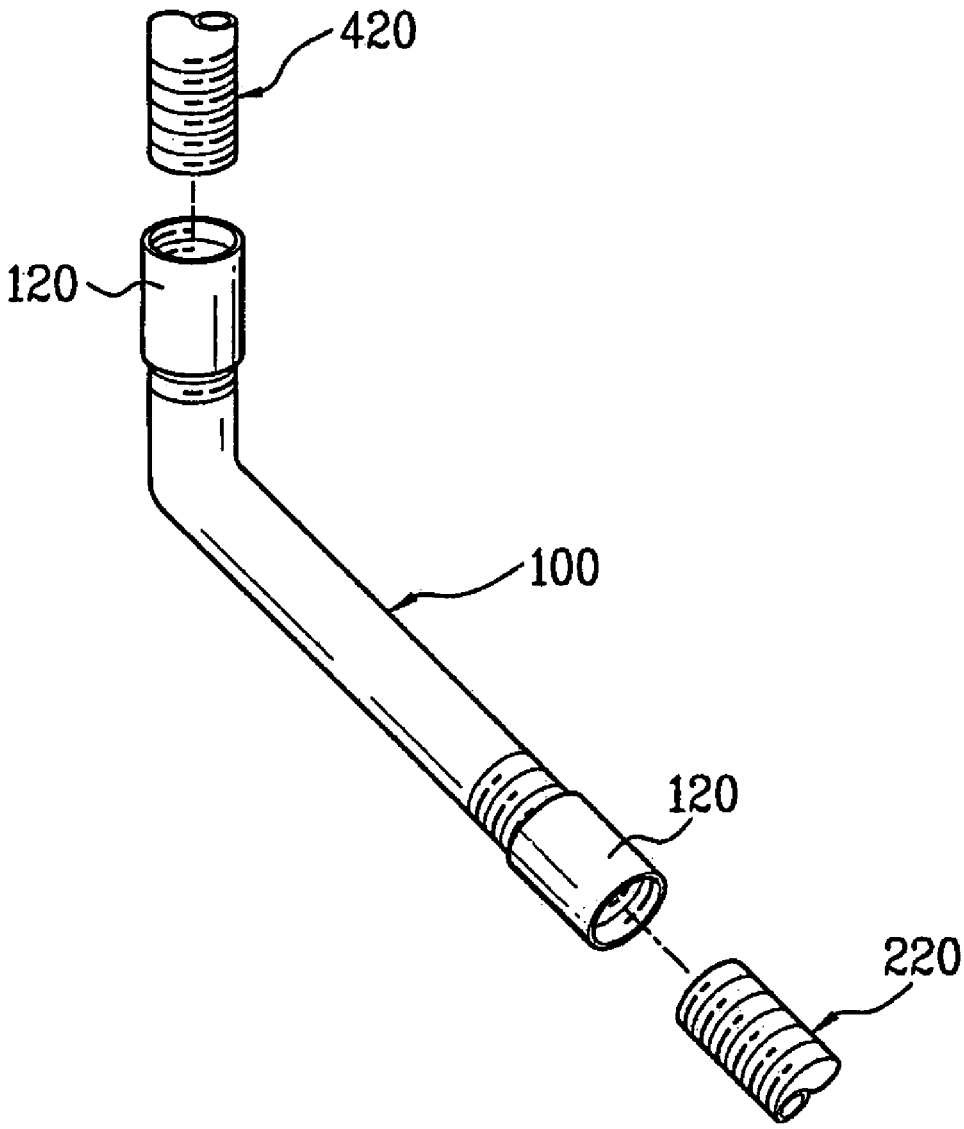
FIG. 5 is a perspective breakaway view of a gasket water draining hose and its coupling bosses, for use in a drum-type washing machine according to another embodiment of the present invention.

FIG. 5 illustrates another embodiment of the present invention. Here, a drum-type washing machine employs a water hose 100 for connecting a gasket 40 to a drainpipe 20, (illustrated in FIG. 4), using first and second bosses 420 and 220 of the gasket. The draining hose 100 is made of a rigid material such as hard plastic or metal, so that each end may be threaded. The first and second bosses 420 and 220 are also threaded. In this case, the bosses 420 and 220 are each formed of a rigid material such as hard plastic or metal.

A coupling member in the form of a threaded sleeve 120 is provided at either end of the water draining hose 100, so that the threaded ends of the water draining hose may be coupled to the threaded ends of the first and second bosses 420 and 220. Though FIG. 5 depicts the coupling member as a sleeve having female threads to couple with male threads of the water draining hose and the first and second bosses, the coupling member may be a sleeve having male threads to couple with female threads of the water draining hose and the first and second bosses. In any event, the sleeves 120 achieve a nut-and-bolt type of screw-coupling, to prohibit separation, but allows for minor displacement at each end of the water draining hose 100.

In the operation of a drum-type washing machine according to the present invention, laundry washing or rinsing is performed by filling the drum 3 and tub 2 with a large amount of water. Thereafter, dewatering and drying steps are executed, to discharge the water via the drainpipe 20.

Upon completion of the dewatering step and during the drying step, residual amounts of the water used for washing or rinsing gather at a recess formed around a bottom point of the gasket 40. This residual water then flows from the gasket's recess out the first orifice 41 of the gasket 40, through the first boss 42 (420), down the water draining hose 10, and out the second orifice 21 of the drainpipe 20, to be discharged via the drainpipe.

The gasket water draining hose of the present invention enables used water to be discharged via the drainpipe, immediately following a washing or rinsing step. The gasket enables the maintenance if a clean environment, prevents contaminated water from combining with newly supplied water for another wash or rinse cycle, and avoids a breakdown of the gasket, which occurs for example if the residual water becomes frozen.

It will be apparent to those skilled in the art that various modifications and variations can be made in the present invention. Thus, it is intended that the present invention covers such modifications and variations, provided they come within the scope of the appended claims and their equivalents.

What is claimed is:

1. A drum-type washing machine comprising:

a cabinet having a door;

a tub for containing water, said tub having an entrance corresponding to the door of said cabinet;

a gasket, connecting the door of said cabinet to the entrance of said tub, to prevent water contained in said tub from leaking outside said tub, said gasket having a first orifice provided at a bottom point thereof;

a drainpipe, connected to said tub, to discharge water contained in said tub, said drainpipe having a sidewall and a second orifice located in the sidewall; and a water draining hose, connecting the first orifice of said gasket to the second orifice of said drainpipe, to discharge water via said drainpipe.

2. The drum-type washing machine as claimed in claim 1, wherein the first orifice includes a cylindrical boss protruding a predetermined length from said gasket and the second orifice includes a cylindrical boss protruding a predetermined length from said drainpipe.

3. The drum-type washing machine as claimed in claim 2, wherein the cylindrical bosses are threaded.

4. The drum-type washing machine as claimed in claim 2, further comprising a pair of coupling members for coupling said water draining hose to each of the cylindrical bosses.

5. The drum-type washing machine as claimed in claim 4, wherein said coupling members are sleeves formed of a rigid material.

6. The drum-type washing machine as claimed in claim 5, wherein the threaded sleeves are provided with female threads and said water draining hose and the cylindrical bosses are each provided with male threads.

7. The drum-type washing machine as claimed in claim 4, wherein said coupling members are fitting stops formed of an elastic material.

8. The drum-type washing machine as claimed in claim 4, wherein said coupling members are fitting stops formed of a rigid material.

9. The drum-type washing machine as claimed in claim 8, further comprising a rubber bushing, installed inside each coupling member, to prevent water leakage.

10. The drum-type washing machine as claimed in claim 1, wherein said water draining hose is formed of a flexible material selected from the group consisting of rubber and plastic.

11. The drum-type washing machine as claimed in claim 1, wherein the door of said cabinet is disposed on a front side of said cabinet.

12. The drum-type washing machine as claimed in claim 1, wherein said drainpipe is a bellows type made of a flexible material.

13. The drum-type washing machine as claimed in claim 1, wherein said water draining hose is integrally formed with at least one of said gasket and said drainpipe.

14. The drum-type washing machine as claimed in claim 1, wherein the cylindrical bosses are formed of a material other than that of said gasket.

15. The drum-type washing machine as claimed in claim 1, wherein the material of the cylindrical bosses is a durable synthetic material.

16. The drum-type washing machine as claimed in claim 2, wherein said water draining hose fully resides above the cylindrical boss of said drainpipe.

17. The drum-type washing machine as claimed in claim 16, wherein said water draining hose has a substantially fixed shape.

* * * * *